US011761714B2

(12) United States Patent
Feng et al.

(10) Patent No.: US 11,761,714 B2
(45) Date of Patent: Sep. 19, 2023

(54) HEAT EXCHANGER AND FIN THEREOF

(71) Applicants: York Guangzhou Air Conditioning and Refrigeration Co., Ltd., Qingyuan (CN); Johnson Controls Technology Company, Auburn Hills, MI (US)

(72) Inventors: Shifeng Feng, Wuxi (CN); Xiaokui Ma, Wuxi (CN); Li Wang, Wuxi (CN); Amie Sun, Wuxi (CN)

(73) Assignee: JOHNSON CONTROLS TYCO IP HOLDINGS LLP, Milwaukee, WI (US)

( * ) Notice: Subject to any disclaimer, the term of this patent is extended or adjusted under 35 U.S.C. 154(b) by 0 days.

(21) Appl. No.: 17/231,938

(22) Filed: Apr. 15, 2021

(65) Prior Publication Data

US 2021/0325127 A1 Oct. 21, 2021

(51) Int. Cl.
*F28F 1/30* (2006.01)
*F28F 1/32* (2006.01)

(52) U.S. Cl.
CPC ..... *F28F 1/325* (2013.01); *F28F 2215/08* (2013.01)

(58) Field of Classification Search
CPC ..... F28F 2215/08; F28F 1/325
(Continued)

(56) References Cited

U.S. PATENT DOCUMENTS 6,644,389 B1 * 11/2003 Kang ..... F28F 1/325 165/181
D566,824 S * 4/2008 Umetsu ..... D23/386
(Continued)

FOREIGN PATENT DOCUMENTS

CN 1140252 A 1/1997
CN 101498562 A 8/2009
(Continued)

OTHER PUBLICATIONS

Chinese Office Action for CN Application No. 202010301870.8, dated Dec. 26, 2022, 7 pages.
(Continued)

*Primary Examiner* — Claire E Rojohn, III
(74) *Attorney, Agent, or Firm* — Fletcher Yoder, P.C.

(57) ABSTRACT

A fin, comprising: multiple fin subunits arranged in multiple rows, the fin subunits in two adjacent rows being arranged in an offset fashion. Each of the fin subunits comprises: a first direction center line and a second direction center line perpendicular to the first direction center line; a hole located at a central part of the fin subunit; four fenestrated zones, with two adjacent fenestrated zones in the four fenestrated zones being arranged as mirror images of each other, centered at the first or second direction center line therebetween; a flat zone comprising a hole periphery flat zone, the hole periphery flat zone being disposed between the hole and each fenestrated zone; each fenestrated zone comprises first, second, third and fourth boundaries, wherein the first boundary is located at that side of each fenestrated zone which faces the hole, the second boundary is located at that side of each fenestrated zone which faces away from the hole, and the third and fourth boundaries extend in a direction parallel to the first direction center line; the first boundary forms a demarcation line between the hole periphery flat zone and each fenestrated zone, and at least a portion of the first boundary is an elliptical arc or a circular arc that is not concentric with the circle center of the hole.

13 Claims, 6 Drawing Sheets

(58) Field of Classification Search
USPC ..... 165/182
See application file for complete search history.

(56) References Cited

U.S. PATENT DOCUMENTS

| | | | | |
|---|---|---|---|---|
| 8,267,160 | B2 * | 9/2012 | Hancock | F28F 1/325 165/182 |
| D700,689 | S * | 3/2014 | Obosu | D23/323 |
| 9,528,779 | B2 * | 12/2016 | Lee | F28F 13/00 |
| 9,605,908 | B2 * | 3/2017 | Kim | F28F 1/325 |
| D800,282 | S * | 10/2017 | Hanson | D23/323 |
| 9,885,525 | B2 * | 2/2018 | Yokozeki | F25B 39/028 |
| 10,209,012 | B2 * | 2/2019 | Berthelot | F28F 1/32 |
| 2011/0036551 | A1 * | 2/2011 | Hancock | F28F 1/325 165/181 |
| 2012/0175101 | A1 * | 7/2012 | Tamura | F28F 1/325 165/181 |
| 2016/0123681 | A1 | 5/2016 | Honma et al. | |

FOREIGN PATENT DOCUMENTS

| | | | |
|---|---|---|---|
| CN | 202393282 | U | 8/2012 |
| CN | 207456255 | U | 6/2018 |
| JP | 2008215737 | A | 9/2008 |

OTHER PUBLICATIONS

Chinese Office Action for CN Application No. 202010301870.8, dated Apr. 27, 2023, 4 pages.

* cited by examiner (i) prior art (ii) present application

HEAT EXCHANGER AND FIN THEREOF

CROSS-REFERENCE TO RELATED APPLICATIONS

This application claims priority from and the benefit of Chinese Patent Application No. 202010301870.8, filed Apr. 16, 2020, which is herein incorporated by reference in its entirety for all purposes.

TECHNICAL FIELD

The present application relates to a heat exchanger, in particular to an improvement to a fin for a finned tube heat exchanger.

BACKGROUND ART

Finned tube heat exchangers are a type of heat exchanger that is widely used in industry (e.g. in refrigerators, air conditioning, food processing, chemical processing, etc.), and which is able to provide a large heat exchange area within a small volume. Finned tube heat exchangers have a series of plate-like fins arranged at intervals, and multiple heat exchange tubes extending through the series of fins. Heat exchange takes place between a fluid (generally a refrigerant) circulating in the heat exchange tubes and a fluid (generally air) flowing between the fins, in order to achieve the objective of heat exchange. The fins take the form of flat plates, which are provided with louvers, for the purpose of increasing the efficiency of heat exchange between the refrigerant and air.

SUMMARY OF THE INVENTION

At least one object of the present application in a first aspect is to provide a fin with a low pressure drop, high heat exchange efficiency and high stability. The fin comprises multiple fin subunits, the multiple fin subunits being arranged in multiple rows, and the fin subunits in two adjacent rows being arranged in an offset fashion. Each of the fin subunits comprises: a first direction center line X and a second direction center line Y, the second direction center line Y being perpendicular to the first direction center line X; a hole, the hole being located at a central part of the fin subunit; four fenestrated zones, with two adjacent fenestrated zones in the four fenestrated zones being arranged as mirror images of each other, centered at the first direction center line X or the second direction center line Y therebetween; a flat zone, the flat zone comprising a hole periphery flat zone, the hole periphery flat zone being disposed between the hole and each of the four fenestrated zones; each of the four fenestrated zones comprises a first boundary, a second boundary, a third boundary and a fourth boundary, wherein the first boundary is located at that side of each of the four fenestrated zones which faces the hole, the second boundary is located at that side of each of the four fenestrated zones which faces away from the hole, and the third boundary and the fourth boundary extend in a direction substantially parallel to the first direction center line X; the first boundary forms a demarcation line between the hole periphery flat zone and each of the four fenestrated zones, and at least a portion of the first boundary is an elliptical arc or a circular arc that is not concentric with the circle center of the hole.

According to the first aspect, the first boundary is a first circular arc structure that is not concentric with the circle center of the hole, and the radius of the first circular arc structure is R1.

According to the first aspect, the distance between the third boundary and the first direction center line X is greater than the distance between the fourth boundary and the first direction center line X, the first boundary comprises a first endpoint intersecting the third boundary, the distance from the first endpoint to the second direction center line Y is Lp, the distance from the first endpoint to the first direction center line X is Lfix, and the distance from an intersection point of an extension line of the first boundary with the first direction center line X to the second direction center line Y is Lmid, wherein the hole has radius R, and wherein R1, Lp, Lfix and Lmid are determined according to R.

According to the first aspect, R1/R is 1.74-2.7, Lp/R is 0.317-0.451, Lfix/R is 1.8-1.95, and Lmid/R is 1.4-1.65.

According to the first aspect, the flat zone further comprises a second edge flat zone, the second edge flat zone being located at that side of each of the four fenestrated zones which faces away from the hole, and the second edge flat zone extending all the way over the fin subunit in a direction parallel to the second direction center line Y.

According to the first aspect, the second boundary forms a demarcation line between each of the four fenestrated zones and the second edge flat zone, wherein the second boundary is a second circular arc structure of radius R2, and a certain gap exists between the circle center of the second circular arc structure and the circle center of the hole.

According to the first aspect, an extension line of the second boundary has a first intersection point with an edge of the fin subunit, the edge being parallel to the first direction center line X; the distance from the first intersection point to the second direction center line Y is Lin; an extension line of the second boundary has a second intersection point with the first direction center line X, and the distance from the second intersection point to the second direction center line Y is Lout; the hole has radius R, wherein R2, Lin and Lout are determined according to R.

According to the first aspect, R2/R is 4.6-11.2, Lout/R is 1.858-2.315, and Lin/R is 1.89-2.2.

According to the first aspect, in each row of the fin subunits, adjacent said fin subunits are connected by means of the second edge flat zones; in the case of two adjacent rows of the fin subunits, one of the rows of the fin subunits and the other row of the fin subunits are offset by approximately half a fin subunit.

At least one object of the present application in a second aspect is to provide a heat exchanger. The heat exchanger comprises:

multiple fins as described in the first aspect above, the multiple fins being arranged side by side, with adjacent fins being spaced apart by a certain distance; and multiple tubes, each tube in the multiple tubes extending through the multiple fins via the hole of each of the fins.

DETAILED DESCRIPTION OF THE INVENTION

Figure 1:
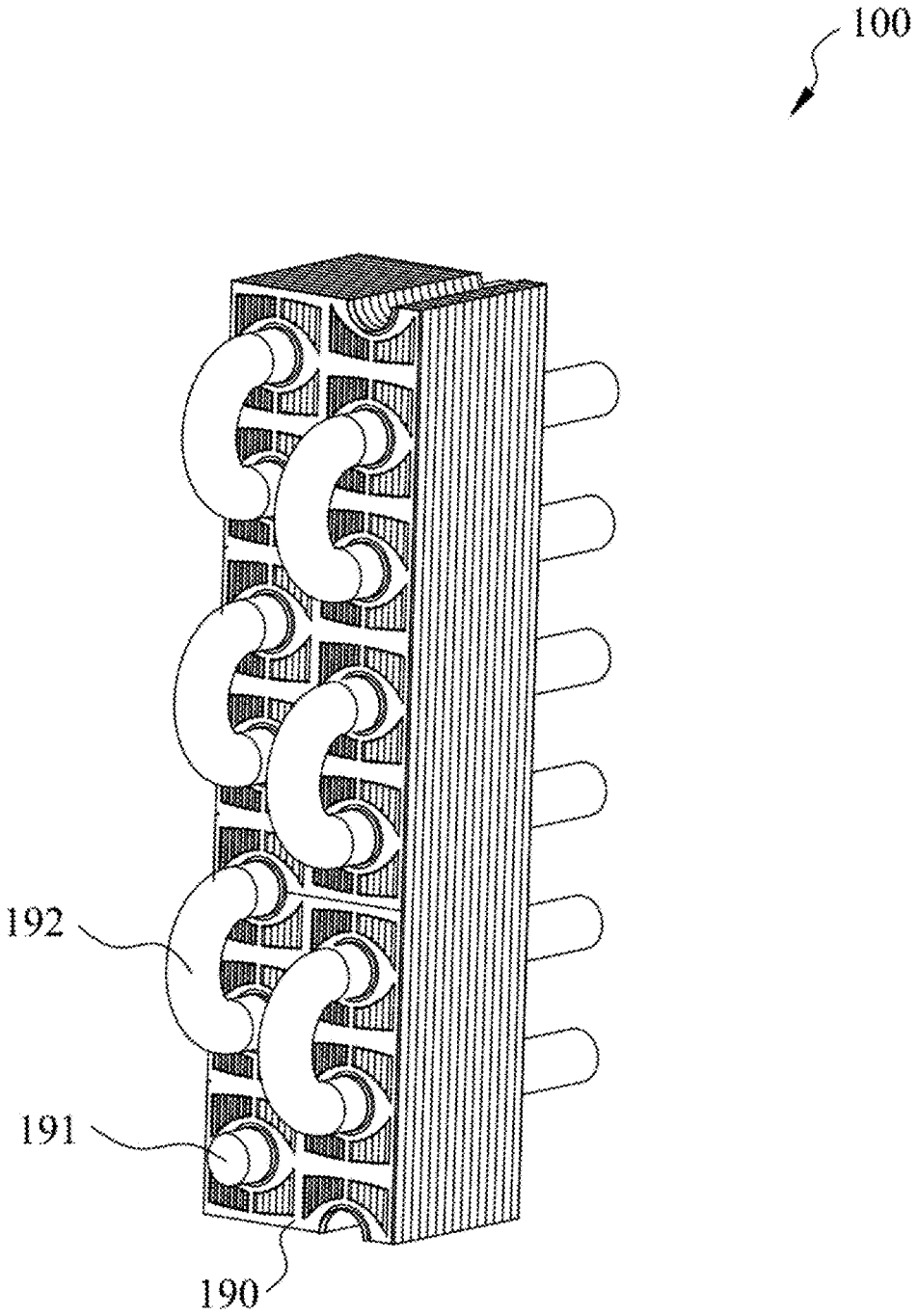
FIG. 1 is a three-dimensional drawing of an embodiment of a finned tube heat exchanger 100 according to the present application.

Various particular embodiments of the present application are described below with reference to the drawings, which form part of this specification. It should be understood that although terms indicating direction, e.g. "front", "rear", "up", "down", "left", "right", etc., are used in the present application to describe various exemplary structural parts and elements of the present application, the sole purpose of using these terms here is to facilitate explanation, and they are determined on the basis of exemplary directions shown in the drawings. The embodiments disclosed in the present application can be arranged according to different directions; thus, these terms indicating direction are merely explanatory, and should not be regarded as limiting.

FIG. 1 is a three-dimensional drawing of an embodiment of a finned tube heat exchanger 100 according to the present application. As shown in FIG. 1, the finned tube heat exchanger 100 comprises multiple heat exchange tubes 191 and multiple fins 190. The multiple fins 190 are arranged side by side in parallel, and adjacent fins are spaced apart by a certain distance, in order to form a channel therebetween for a fluid to flow through. The multiple heat exchange tubes 191 extend through all of the fins 190. The multiple heat exchange tubes 191 are connected at one end thereof by a curved tube 192, thus forming pairs. The heat exchange tubes 191 can be used to guide a fluid (e.g. a coolant) to flow therethrough. The coolant flowing in one direction in one heat exchange tube 191 can, after changing direction in the curved tube, flow in the opposite direction through another heat exchange tube 191. A fluid (e.g. air) can be made to flow through the fluid channels between the fins 190, along surfaces of the fins 190, and the air can thereby undergo heat exchange with refrigerant in the heat exchange tubes 191 by means of the fins 190 and the heat exchange tubes 191.

The heat exchange tubes 191 can be of any suitable size. The number of heat exchange tubes 191 can be arbitrary. The heat exchange tubes 191 can be made of any suitable material having good heat transfer properties. The number of fins 190 can also be arbitrary. The fins 190 can also be of any suitable size. The fins 190 can be made of aluminum, or any suitable metal material having good heat transfer properties.

Figure 2A:
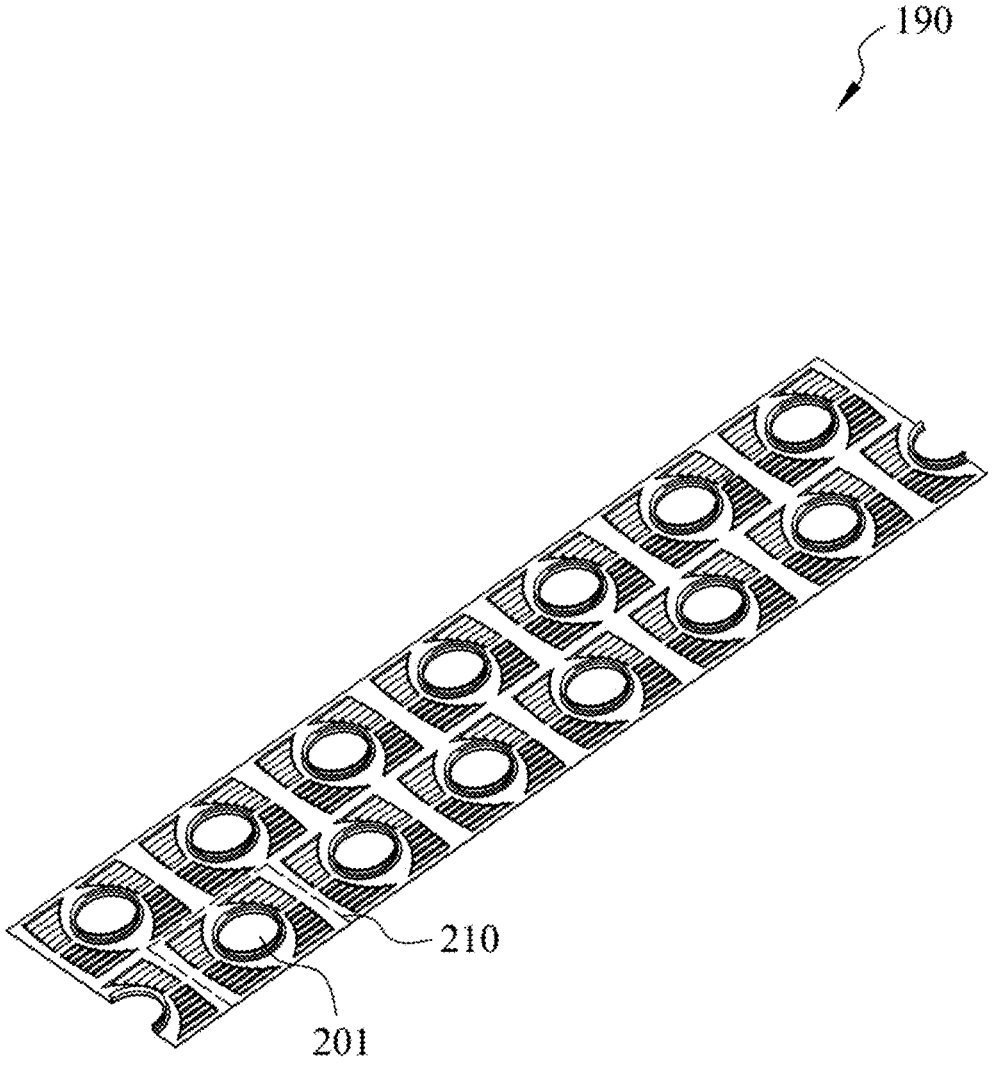
FIG. 2A is a three-dimensional drawing of an embodiment of a fin 190 according to the present application.

FIG. 2A is a three-dimensional drawing of an embodiment of the fin 190 according to the present application, and shows a two-row fin. As shown in FIG. 2A, the fin 190 substantially takes the form of a flat plate. The fin 190 comprises multiple fin subunits 210, and these multiple fin subunits 210 are identical. Each fin subunit 210 is provided with a hole 201 in a central position, the circle center of the hole 201 coinciding with the center point of the fin subunit 210. Multiple fin subunits 210 are arranged in two rows, with the fin subunits 210 in each row being connected in sequence. The two rows of fin subunits 210 are arranged in an offset fashion, so that the holes 201 in the two rows of fin subunits 210 are arranged in an offset fashion, wherein the holes 201 in one row of fin subunits 210 are aligned with the junctions of adjacent fin subunits 210 in the other row.

Figure 2B:
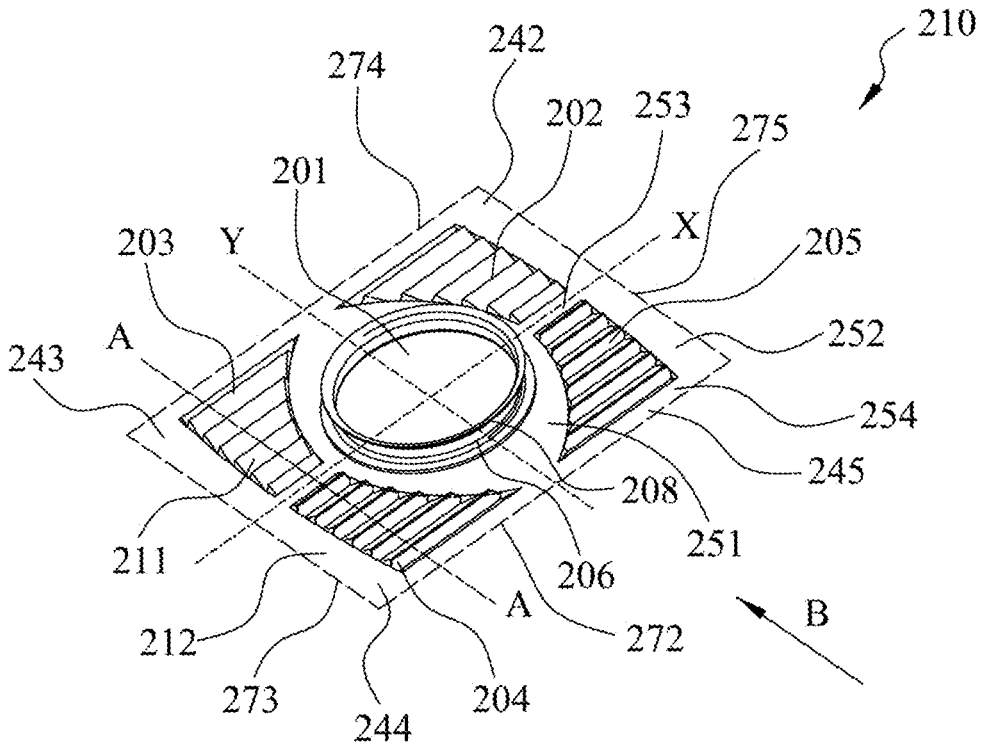
FIG. 2B is a three-dimensional drawing of the front of a fin subunit 210 of the fin 190 shown in FIG. 2A.
Figure 2C:
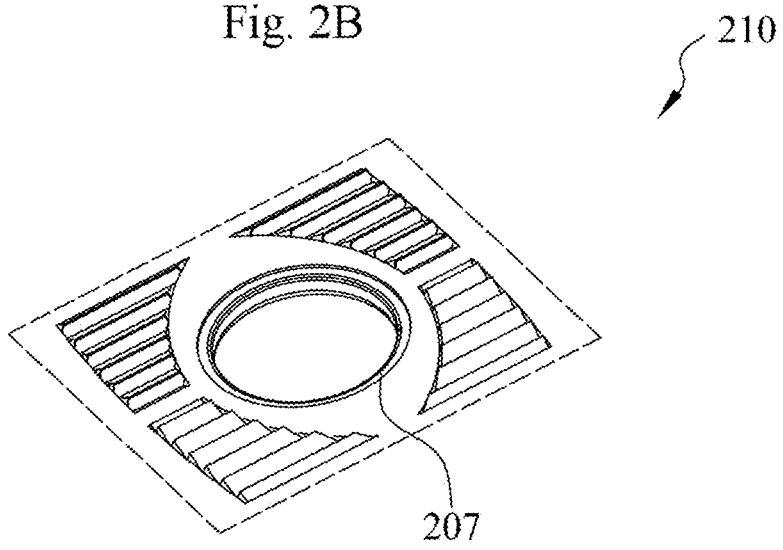
FIG. 2C is a three-dimensional drawing of the back of the fin subunit 210 shown in FIG. 2B.
Figure 2D:
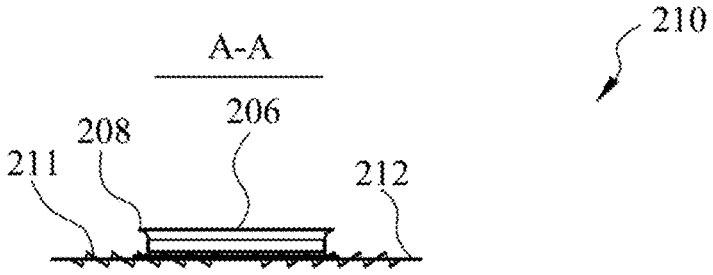
FIG. 2D is a sectional view of the fin subunit 210, taken along line A-A in FIG. 2B.

FIG. 2B is a three-dimensional drawing of the front of the fin subunit 210 of the fin 190 shown in FIG. 2A; FIG. 2C is a three-dimensional drawing of the back of the fin subunit 210 shown in FIG. 2B; FIG. 2D is a sectional view of the fin subunit 210, taken along line A-A in FIG. 2B. As shown in FIGS. 2B-2D, the fin subunit 210 is substantially rectangular. The purpose of the hole 201 at the center of the fin subunit 210 is to allow the heat exchange tube 191 to pass through. The inner diameter of the hole 201 is matched to the outer diameter of the heat exchange tube 191, so that the fin 190 can be supported by the heat exchange tube 191 by means of the hole 201 in such a way as to be substantially perpendicular to the heat exchange tube 191. A mounting ring 206 is provided around the hole 201; the mounting ring 206 is connected at one end thereof to an edge of the hole 201, and at the other end thereof is provided with an outward-bent flange 208. A hole wall of the hole 201 is provided with an annular groove 207 (shown in FIG. 2C). The size of the annular groove 207 is matched to the size of the flange 208 of the mounting ring 206, and the flange 208 of the mounting ring 206 can be inserted into the annular groove 207, to connect two adjacent fins 190 together.

As shown in FIG. 2B, the fin subunit 210 has a virtual first direction center line X and a virtual second direction center line Y which pass through the circle center of the hole 201, the second direction center line Y being perpendicular to the first direction center line X. The fin subunit 210 comprises a front edge 272 and a rear edge 274 which are parallel to the first direction center line X, and a left edge 273 and a right edge 275 which are parallel to the second direction center line Y. When used in the heat exchanger, the direction of flow of air past the fin surface is substantially parallel to the second direction center line Y. For convenience of description, the direction of flow of air past the fin surface is represented by an arrow B in FIG. 2B.

The first direction center line X and second direction center line Y divide the fin subunit 210 into four identical rectangular regions 242, 243, 244, 245. Each of the four regions 242, 243, 244, 245 has one quarter of the hole 201, and a corresponding fenestrated zone 202, 203, 204, 205. The fenestrated zone of each region 242, 243, 244, 245 is separated from the corresponding front edge 272/rear edge 274, left edge 273/right edge 275 and the hole 201 by a certain distance, and the fenestrated zones of adjacent regions are also separated by a certain distance; thus, each region 242, 243, 244, 245 not only contains a fenestrated zone, but also contains a continuous flat zone 212 around the fenestrated zone—this will be described in detail below.

The fenestrated zones 202, 203, 204, 205 of the four regions 242, 243, 244, 245 comprise a first fenestrated zone 202, a second fenestrated zone 203, a third fenestrated zone 204 and a fourth fenestrated zone 205. The four fenestrated zones are arranged around the hole 201 in the following manner: the first fenestrated zone 202 and fourth fenestrated zone 205 are arranged as mirror images of each other relative to the first direction center line X (i.e. centered at the first direction center line X), the second fenestrated zone 203 and third fenestrated zone 204 are arranged as mirror images of each other relative to the first direction center line X (i.e. centered at the first direction center line X), the first fenestrated zone 202 and second fenestrated zone 203 are arranged as mirror images of each other relative to the second direction center line Y (i.e. centered at the second direction center line Y), and the third fenestrated zone 204 and fourth fenestrated zone 205 are arranged as mirror images of each other relative to the second direction center line Y (i.e. centered at the second direction center line Y).

Multiple louver slats 211 are provided in each of the four fenestrated zones 202, 203, 204, 205. Each louver slat 211 is substantially rectangular, and is formed by cutting the plate material of the fin 190 into the form of a slat, and then turning the material that has been cut into the form of a slat so that it is inclined relative to the fin 190. Each louver slat 211 extends in a direction parallel to the first direction center line X. The multiple louver slats 211 in each fenestrated zone are spaced apart, and are arranged parallel to each other in a direction parallel to the second direction center line Y. As shown in FIG. 2D, the louver slats 211 in the two fenestrated zones at two sides of the first direction center line X (e.g. the second fenestrated zone 203 and third fenestrated zone 204) are inclined in opposite directions, wherein the louver slats 211 in the second fenestrated zone 203 are angled forward relative to the direction B of flow of air along the fin surface, and the louver slats 211 in the third fenestrated zone 204 are angled rearward relative to the direction B of flow of air along the fin surface.

As stated above, each region 242, 243, 244, 245 also has the continuous flat zone 212 around the fenestrated zone thereof. Taking the fourth region 245 as an example, the flat zone 212 comprises a hole periphery flat zone 251, a first edge flat zone 254, an inter-louver flat zone 253 and a second edge flat zone 252. The hole periphery flat zone 251 is located between the hole 201 and the fourth fenestrated zone 205; the second edge flat zone 252 is opposite the hole periphery flat zone 251, being located at that side of the fourth fenestrated zone 205 which faces away from the hole 201, and being defined by the right edge 275. The inter-louver flat zone 253 is located at that side of the fourth fenestrated zone 205 which faces the first fenestrated zone 202, and is defined by the first direction center line X. The first edge flat zone 254 is opposite the inter-louver flat zone 253, being located at that side of the fourth fenestrated zone 205 which faces away from the inter-louver flat zone 253, and being defined by the front edge 272. The hole periphery flat zone 251, first edge flat zone 254, second edge flat zone 252 and inter-louver flat zone 253 are connected to each other contiguously, separating the fourth fenestrated zone 205 from the edge of the hole 201 and the adjacent fenestrated zones.

Figure 3:
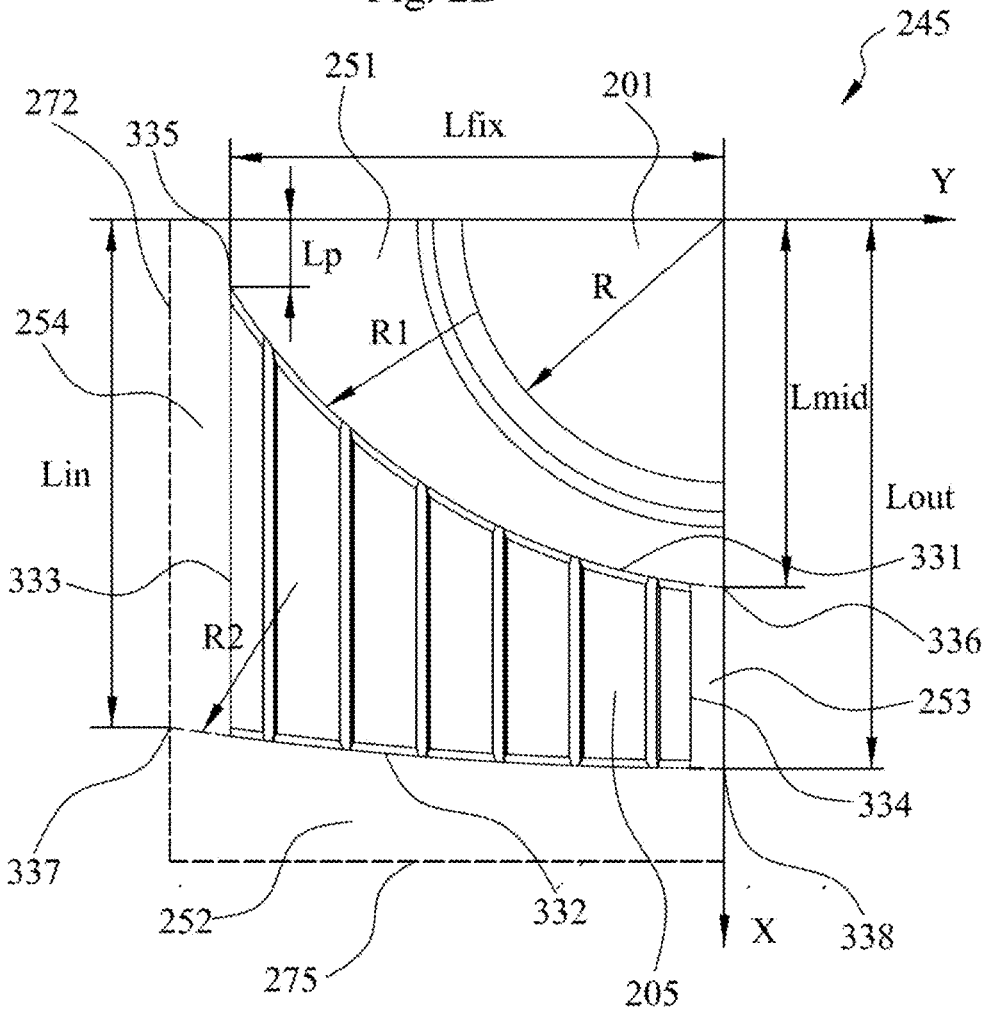
FIG. 3 is a partial enlarged drawing of one region of the fin subunit 210 shown in FIG. 2C.

FIG. 3 is a partial enlarged drawing of one region of the fin subunit 210 shown in FIG. 2C. Specifically, FIG. 3 shows a particular structure of one region of the fin subunit 210, taking the fourth region 245 as an example. As shown in FIG. 3, the fourth region 245 is defined by the first direction center line X, the right edge 275, the second direction center line Y and the front edge 272. The fourth fenestrated zone 205 in the fourth region 245 is defined by a first boundary 331, a second boundary 332, a third boundary 333 and a fourth boundary 334. The first boundary 331 and second boundary 332 are located at two opposite sides of the fourth fenestrated zone 205; the third boundary 333 and fourth boundary 334 are located at two other opposite sides of the fourth fenestrated zone 205. Specifically, the first boundary 331 is located at that side of the fourth fenestrated zone 205 which faces the hole 201, and forms a demarcation line between the hole periphery flat zone 251 and the fourth fenestrated zone 205. The second boundary 332 forms a demarcation line between the fourth fenestrated zone 205 and the second edge flat zone 252. The third boundary 333 forms a demarcation line between the fourth fenestrated zone 205 and the first edge flat zone 254. The fourth boundary 334 forms a demarcation line between the fourth fenestrated zone 205 and the inter-louver flat zone 253.

The first boundary 331 is a circular arc structure; the circle center of the first boundary 331 is offset from the circle center of the hole 201, and separated therefrom by a certain distance. The radius of the first boundary 331 is R1; the radius of the heat exchange tube 191 (i.e. the radius of the hole 201) is R; the radius of the first boundary 331 and the radius of the heat exchange tube 191 satisfy R1/R=1.74-2.7. The distances from a first endpoint 335 of the first boundary 331 to the first direction center line X and the second direction center line Y are Lfix and Lp respectively; these distances and the radius R of the heat exchange tube 191 satisfy Lfix/R=1.8-1.95 and Lp/R=0.317-0.451 respectively. An extension line of the first boundary 331 has an intersection point 336 with the first direction center line X, and the distance from the intersection point 336 to the second direction center line Y is Lmid; this distance and the radius R of the heat exchange tube 191 satisfy Lmid/R=1.4-1.65.

The second boundary 332 is also a circular arc structure; the circle center of the second boundary 332 is separated from the circle center of the hole 201 by a certain distance. The second boundary 332 forms a demarcation line between the fourth fenestrated zone 205 and the second edge flat zone 252. The radius of the second boundary 332 is R2; this radius and the radius R of the heat exchange tube 191 satisfy R2/R=4.6-11.2. An extension line of the second boundary 332 has a first intersection point 337 with the front edge 272, and has a second intersection point 338 with the first direction center line X, and the distances from the first intersection point 337 and the second intersection point 338 to the second direction center line Y are Lin and Lout respectively; these distances and the radius R of the heat exchange tube 191 satisfy Lout/R=1.858-2.315 and Lin/R=1.89-2.2 respectively.

The third boundary 333 and fourth boundary 334 are line segments that are substantially parallel to the first direction center line X, and connect endpoints at two sides respectively of the first boundary 331 and second boundary 332. The distance Lfix between the third boundary 333 and the first direction center line X is greater than the distance between the fourth boundary 334 and the first direction center line X.

Based on the relationships between the parameters of the boundaries of the fenestrated zones above and the edges of the regions in which the fenestrated zones are located, the positions of the fenestrated zones in the corresponding regions can be determined by the demonstrative method below (taking the fourth fenestrated zone 205 of the fourth region 245 as an example for illustration).

(1) Establishing a coordinate system: a coordinate system is established using the circle center of the hole 201, taking the first direction center line X and second direction center line Y of the fin subunit 210 as the X axis and Y axis of the coordinate system.

(2) Determining the position, in the fourth region 245, of the first boundary 331 of the fourth fenestrated zone 205: based on the relationship between Lp/Lfix/Lmid and the radius R of the heat exchange tube 191, the coordinates of the first endpoint 335 of the first boundary 331 are determined, and the coordinates of the intersection point 336 of the first boundary 331 with the first direction center line X are determined; based on the relationship between R1 and R, the radius R1 of the first boundary 331 is determined; once the radius R1 of the first boundary 331, the coordinates of the first endpoint 335 of the first boundary 331 and the coordinates of the intersection point 336 of the first boundary 331 with the first direction center line X have been determined, the position of the first boundary 331 in the fourth region 245 can be determined.

(3) Determining the position, in the fourth region 245, of the second boundary 332 of the fourth fenestrated zone 205: based on the relationship between Lin/Lout and the radius R of the heat exchange tube 191, the coordinates of the first intersection point 337 of the second boundary 332 with the front edge 272 are determined, and the coordinates of the second intersection point 338 of the second boundary 332 with the first direction center line X are determined; based on the relationship between R2 and R, the radius R2 of the second boundary 332 is determined; once the coordinates of the first intersection point 337 and second intersection point 338 and the radius R2 of the second boundary 332 have been determined, the position of the second boundary 332 of the fourth fenestrated zone 205 in the fourth region 245 can be determined.

(4) Determining the position, in the fourth region 245, of the third boundary 333 of the fourth fenestrated zone 205: the third boundary 333 is parallel to the first direction center line X, and the first endpoint 335 of the first boundary 331 forms an endpoint of the third boundary 333; based on the distance Lfix from the first endpoint 335 to the first direction center line X, the position of the third boundary 333 in the fourth region 245 can be determined.

(5) Determining the position, in the fourth region 245, of the fourth boundary 334 of the fourth fenestrated zone 205: based on the number and fenestration positions of the louver slats 211, and further taking the third boundary 333 as a starting point, the position of the fourth boundary 334 in the fourth region 245 is determined between the third boundary 333 and the first direction center line X.

Once the positions of the boundaries of the fourth fenestration zone 205 have been determined by the demonstrative method above, the positions of the first fenestration zone 202, second fenestration zone 203 and third fenestration zone 204 on the fin subunit 210 can be determined by means of mirror images, and the positions of all of the fenestration zones and flat zones on the fin subunit 210 can thereby be determined.

In the heat exchanger, when air flows past the surface of the fin 190, the louver slats 211 on the fin will obstruct the flow of air due to the fact that they extend transversely to the direction of airflow, such that the flow of air experiences turbulence, and the heat exchange effect is thus improved. However, at the same time, the presence of the louver slats 211 also causes the pressure drop of air in the heat exchanger to increase. In addition, the airflow will also experience a large pressure drop around the heat exchange tube. When air flows past the flat zone 212 of the fin, since the flat zone 212 presents no obstruction, the air has a faster flow speed when flowing past the flat zone 212, and has a very small pressure drop. However, although a faster flow speed of air can also improve the heat exchange effect, the influence thereof on the heat exchange effect is smaller than the influence of the louver slats 211 on heat exchange due to perturbing the flow of air. Taking into account both the pressure drop and the heat exchange performance, a design that balances the areas of the flat zone 212 and the fenestrated zones 202, 203, 204, 205 is of vital importance.

It can be seen from FIG. 2A that in each row of fin subunits 210, adjacent fin subunits 210 are connected by means of the second edge flat zones 252. In the case of two adjacent rows of fin subunits 210, a first row of fin subunits 210 and a second row of fin subunits are offset by approximately half a fin subunit, such that the hole periphery flat zones 251 of the first row of fin subunits 210 are aligned with the second edge flat zones 252 of two adjacent fin subunits 210 in the second row. Similarly, the second edge flat zones 252 of two adjacent fin subunits 210 in the first row of fin subunits 210 are aligned with the hole periphery flat zones 251 in the second row of fin subunits 210. The second edge flat zones 252 extend all the way over the fin subunits 210 in a direction parallel to the second direction center line Y; thus, when flowing past the fin 190, air first flows past the second edge flat zones 252 and hole periphery flat zones 251 in the first row of fin subunits 210, and then consecutively flows past the hole periphery flat zones 251 and second edge flat zones 252 in the second row of fin subunits 210, without being obstructed by the fenestrated zones. It is worth noting that the circular-arc-shaped structure of the first boundary 331 can guide the flow direction of air, increasing the flow speed of air in the hole periphery flat zone 251 at a rear part of the heat exchange tube 191, and thus improving the heat exchange effect of the fin 190. The circular-arc-shaped structure of the second boundary 332 in the first row of fin subunits 210 can guide air to flow into the hole periphery flat zone 251 in the second row of fin subunits 210, reducing the loss of speed of air when entering the hole periphery flat zone 251 in the second row of fin subunits 210, and thus improving the heat exchange effect of the fin 190. Moreover, based on the above-described structural design of the fin subunit 210, the included angle between the air speed vector and the air temperature gradient vector when air is flowing past the fin subunit 210 is smaller than the included angle between these two vectors when air is flowing past a fin in the prior art; this is beneficial for heat exchange.

Figure 4A:
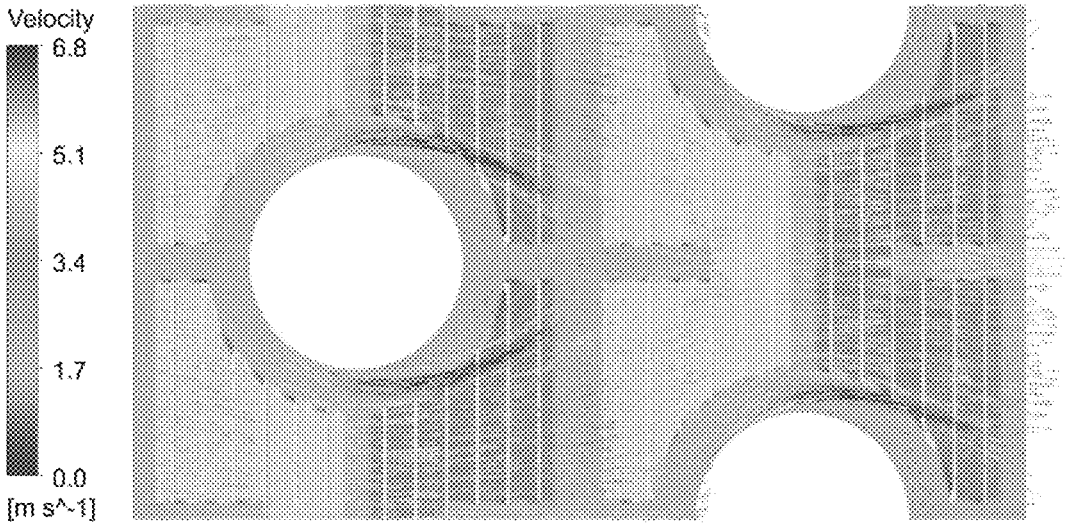
FIG. 4A shows effect diagrams of the flow speed and distribution of air when flowing past the fin 190 in FIG. 2A and a fin in the prior art.
Figure 4A:
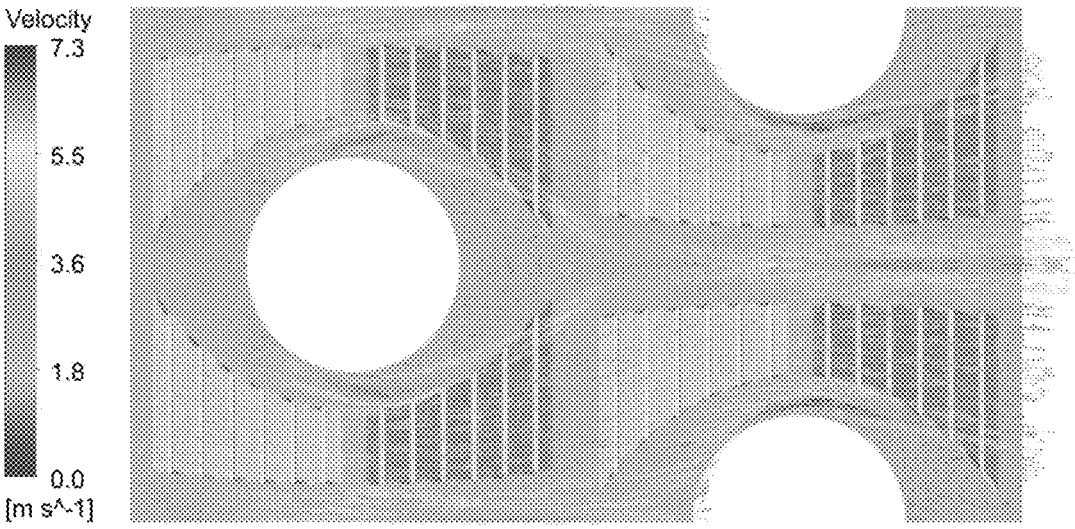

FIG. 4A shows effect diagrams of the flow speed and distribution of air when flowing past the fin 190 in FIG. 2A and a fin in the prior art. Specifically, FIG. 4A shows flow speed and distribution effect diagrams of air when flowing past the fin 190 and a fin in the prior art, in the case where the diameter of the heat exchange tube 191 is 12.7 mm and the air has a flow speed of 2.5 m/s when entering a heat exchanger fin set. The depth of color of the airflow-like shadows in the figure represents the magnitude of the air flow speed; a deeper color indicates a denser airflow, and a higher flow speed of air. As shown in FIG. 4A, the flow speed of air on the fin 190 after flowing past the heat exchange tube 191 (i.e. the flow speed in the second edge flat zones 252 of two adjacent fin subunits 210) is significantly greater than the flow speed of air at a corresponding position in the prior art; this indicates that the pressure drop of air when flowing past the fin 190 is smaller than for the fin in the prior art.

Figure 4B:
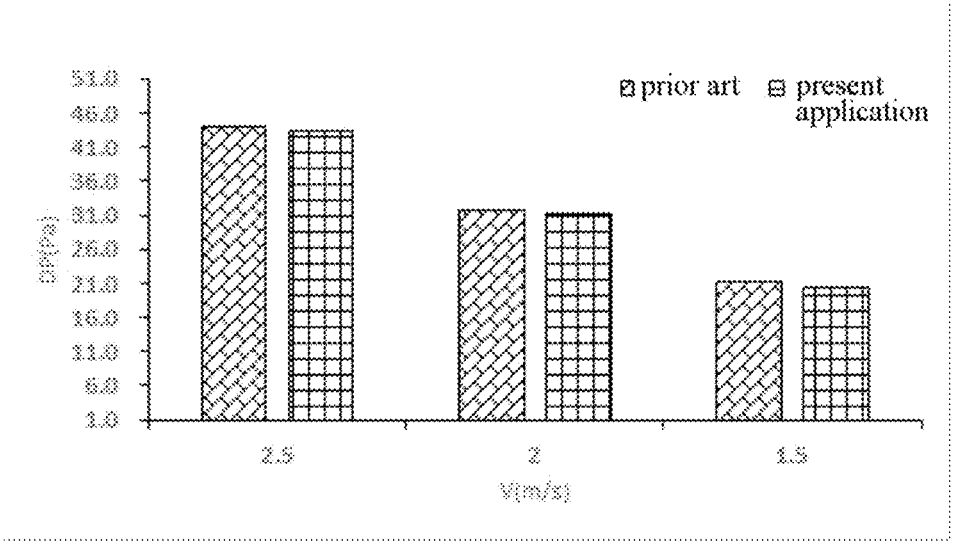
FIG. 4B is a comparison chart of the pressure drops of air when flowing past the fin 190 of the present application and in the prior art, for different flow speeds.

FIG. 4B is a comparison chart of the pressure drops of air when flowing past the fin 190 of the present application and in the prior art, for different flow speeds. In FIG. 4B, the horizontal coordinate represents the flow speed of air when entering a heat exchanger fin set, and the vertical coordinate represents the pressure drop DP. As shown in FIG. 4B, at the different flow speeds, the pressure drop DP of the fin 190 of the present application is in each case smaller than the pressure drop of the fin in the prior art; moreover, the greater the flow speed of air, the greater the difference between the pressure drops.

Figure 4C:
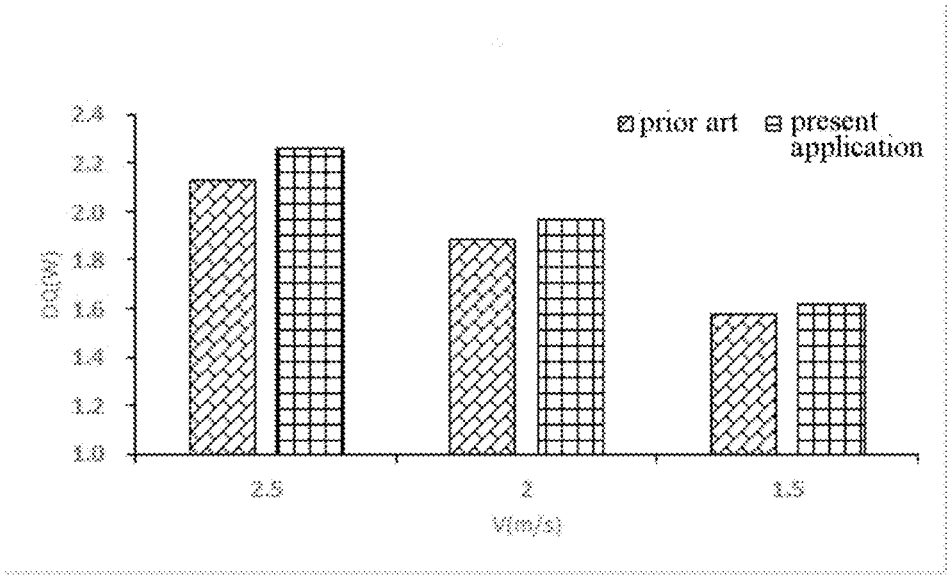
FIG. 4C is a comparison chart of the heat exchange effects of the fin 190 of the present application and in the prior art, for different flow speeds.

FIG. 4C is a comparison chart of the heat exchange effects of the fin 190 of the present application and in the prior art, for different flow speeds. In FIG. 4C, the horizontal coordinate represents the flow speed of air when entering a heat exchanger fin set, and the vertical coordinate represents the heat exchange efficiency DQ. As shown in FIG. 4C, at the different flow speeds, the heat exchange efficiency DQ of the fin 190 of the present application is in each case greater than the heat exchange efficiency of the fin in the prior art; moreover, the greater the flow speed of air, the greater the difference between the heat exchange efficiencies.

It is worth noting that in the embodiment shown in FIG. 2A, the fin has only two rows of fin subunits, but those skilled in the art should know that the structural design for the fin subunit in the present application is applicable to fins having any number of rows of fin subunits.

In addition, although the first boundary 331 is a circular arc structure in the embodiment shown in FIGS. 2A-3, according to the present application, the first boundary 331 may also be elliptical-arc-shaped, or be formed by joining together a circular arc segment that is concentric with the circle center of the hole 201 and another circular arc segment that is not concentric with the circle center of the hole 201. The second boundary 332 may also be elliptical-arc-shaped, and may even be a line segment that connects the two endpoints of the second boundary 332 directly. Compared with a fin in the prior art, such a configuration can likewise improve the heat exchange effect of the fin 190 and reduce the pressure drop of air.

Through the above-described design of the boundary positions and shapes of the fenestrated zones in the fin subunit, the present application optimizes the relative areas of the flat zone 212 and the fenestrated zones 202, 203, 204, 205 in a rational way, and can thereby reduce the pressure drop of the airflow while improving the heat exchange performance of the fin. Such an arrangement enables air to retain a greater flow speed when passing the second edge flat zones 252 of two adjacent fin subunits 210 in the second row after passing the heat exchange tube 191 on the first row of fins 190, thus effectively reducing the pressure drop of air when flowing past the entire fin 190. In addition, the area of the flat zone 212 of the fin 190 is larger than that of a planar zone of a fin in the prior art; as a result, the structural stability of the fin 190 is higher than that of the fin in the prior art, and the fin 190 will not produce noise at high airflow speeds.

The present application is described with reference to the particular embodiments shown in the drawings; however, it should be understood that the fin of the present application can have many variant forms, without deviating from the spirit, scope and background of the teaching of the present application. Those skilled in the art will also realize that structural details in the embodiments disclosed in the present application can be modified in different ways, which all fall within the spirit and scope of the present application and the claims.

The invention claimed is:

1. A fin for a heat exchanger, wherein:

the fin comprises multiple fin subunits, the multiple fin subunits being arranged in multiple rows, and the fin subunits in two adjacent rows being arranged in an offset fashion, wherein each of the fin subunits comprises:

a first direction center line and a second direction center line, the second direction center line being perpendicular to the first direction center line;

a hole, the hole being located at a central part of the fin subunit;

four fenestrated zones, with two adjacent fenestrated zones in the four fenestrated zones being arranged as mirror images of each other, centered at the first direction center line or the second direction center line therebetween; and a flat zone, the flat zone comprising a hole periphery flat zone, wherein the hole periphery flat zone is a continuous surface circumscribing the hole and is disposed between the hole and each of the four fenestrated zones, wherein each of the four fenestrated zones comprises a first boundary, a second boundary, a third boundary, and a fourth boundary, wherein the first boundary is located on a first side of the respective fenestrated zone which faces the hole, the second boundary is located on a second side of the respective fenestrated zone which faces away from the hole, and the third boundary and the fourth boundary extend in a common direction with the first direction center line, wherein the first boundary forms a demarcation line between the hole periphery flat zone and each of the four fenestrated zones, and at least a portion of the first boundary is an elliptical arc or a circular arc that is not concentric with a center of the hole.

2. The fin as claimed in claim 1, wherein:

the first boundary is a first circular arc structure that is not concentric with the center of the hole, and a radius of the first circular arc structure is R1.

3. The fin as claimed in claim 2, wherein:

a first distance between the third boundary and the first direction center line is greater than a second distance between the fourth boundary and the first direction center line, the first boundary comprises a first endpoint intersecting the third boundary, a third distance from the first endpoint to the second direction center line is Lp, a fourth distance from the first endpoint to the first direction center line is Lfix, and a fifth distance from an intersection point of an extension line of the first boundary with the first direction center line to the second direction center line is Lmid, wherein the hole has a radius R, and wherein R1, Lp, Lfix and Lmid are determined according to the radius R.

4. The fin as claimed in claim 3, wherein:

R1/R is 1.74-2.7, Lp/R is 0.317-0.451, Lfix/R is 1.8-1.95, and Lmid/R is 1.4-1.65.

5. The fin as claimed in claim 3, wherein:

the flat zone further comprises a plurality of second edge flat zones, each second edge flat zone of the plurality of second edge flat zones being located adjacent the respective second side of one of the four fenestrated zones which faces away from the hole, and the plurality of second edge flat zones extends across the fin subunit in a direction parallel to the second direction center line.

6. The fin as claimed in claim 5, wherein:

the second boundary forms an additional demarcation line between each of the four fenestrated zones and the plurality of second edge flat zones, wherein the second boundary is a second circular arc structure having a radius R2, and a gap extends between a circle center of the second circular arc structure and the center of the hole.

7. The fin as claimed in claim 6, wherein:

a first extension line of the second boundary has a first intersection point with an edge of the fin subunit, the edge being parallel to the first direction center line;

a sixth distance from the first intersection point to the second direction center line is Lin;

a second extension line of the second boundary has a second intersection point with the first direction center line, and a seventh distance from the second intersection point to the second direction center line is Lout; and R2, Lin, and Lout are determined according to the radius R.

8. The fin as claimed in claim 7, wherein:

R2/R is 4.6-11.2, Lout/R is 1.858-2.315, and Lin/R is 1.89-2.2.

9. The fin as claimed in claim 5, wherein:

in each row of the fin subunits, adjacent fin subunits are connected by respective second edge flat zones of the adjacent fin subunits.

10. A heat exchanger, comprising:

a plurality of fins, the plurality of fins being arranged side by side, with adjacent fins being spaced apart by a distance, wherein each fin of the plurality of fins comprises:

a plurality of fin subunits, the plurality of fin subunits being arranged in a plurality of rows, wherein fin subunits in two adjacent rows are arranged in an offset fashion, wherein each fin subunit of the plurality of fin subunits comprises:

a first direction center line and a second direction center line, the second direction center line being perpendicular to the first direction center line;

a hole, the hole being located at a central part of the fin subunit;

four fenestrated zones, with two adjacent fenestrated zones of the four fenestrated zones being arranged as mirror images of each other, centered at the first direction center line or the second direction center line therebetween; and a flat zone, the flat zone comprising a hole periphery flat zone, wherein the hole periphery flat zone is a continuous surface circumscribing the hole and is disposed between the hole and each of the four fenestrated zones, wherein each of the four fenestrated zones comprises a first boundary, a second boundary, a third boundary, and a fourth boundary, wherein the first boundary is located on a first side of the respective fenestrated zone which faces the hole, the second boundary is located on a second side of the respective fenestrated zone which faces away from the hole, and the third boundary and the fourth boundary extend in a common direction with the first direction center line, wherein the first boundary forms a demarcation line between the hole periphery flat zone and each of the four fenestrated zones, and at least a portion of the first boundary is an elliptical arc or a circular arc that is not concentric with a center of the hole; and a plurality of tubes, each tube of the plurality of tubes extending through the plurality of fins via the respective holes of the plurality of fins.

11. The fin as claimed in claim 5, wherein the fin comprises a first row of fin subunits adjacent a second row of fun subunits, and wherein the first row of fin subunits is offset from the second row of fin subunits by half of a fin subunit length.

12. The fin as claimed in claim 11, wherein the hole periphery flat zones of the fin subunits in the first row of fin subunits are aligned with corresponding second edge flat zones of the fin subunits in the second row of fin subunits.

13. A fin for a heat exchanger comprising:

a plurality of fin subunits arranged in two or more rows, wherein each fin subunit of the plurality of subunits comprises:

a hole formed in the fin subunit;

a hole periphery flat zone circumscribing the hole; and four fenestrated zones bordering the hole periphery flat zone, wherein each fenestrated zone of the four fenestrated zones comprises:

a first boundary bordering the hole periphery flat zone, wherein the first boundary is an elliptical arc or a circular arc, and the first boundary is not concentric with a center of the hole;

a second boundary opposite the first boundary relative to the fenestrated zone;

a third boundary extending from the first boundary to the second boundary; and a fourth boundary extending from the first boundary to the second boundary, wherein the fourth boundary is opposite the third boundary relative to the fenestrated zone.

* * * * *